US009752238B2

(12) United States Patent
Schapiro et al.

(10) Patent No.: US 9,752,238 B2
(45) Date of Patent: Sep. 5, 2017

(54) METHOD AND FORMULATIONS FOR REMOVING RUST AND SCALE FROM STEEL AND FOR REGENERATING PICKLING LIQUOR IN HOT-DIP GALVANIZATION PROCESS

(71) Applicant: GREEN FUTURE LTD., Rehovot (IL)

(72) Inventors: Reuben Schapiro, Rehovot (IL); Vladimir Boiko, Kiryat Malachi (IL); Lev Shapiro, Beer Sheva (IL)

(73) Assignee: Green Future Ltd., Rehovot (IL)

( * ) Notice: Subject to any disclaimer, the term of this patent is extended or adjusted under 35 U.S.C. 154(b) by 0 days.

(21) Appl. No.: 15/303,051

(22) PCT Filed: Apr. 15, 2015

(86) PCT No.: PCT/IL2015/050405
§ 371 (c)(1),
(2) Date: Oct. 10, 2016

(87) PCT Pub. No.: WO2015/162604
PCT Pub. Date: Oct. 29, 2015

(65) Prior Publication Data

US 2017/0037520 A1 Feb. 9, 2017

Related U.S. Application Data

(60) Provisional application No. 61/982,384, filed on Apr. 22, 2014.

(51) Int. Cl.

| | |
|---|---|
| ***C23C 2/02*** | (2006.01) |
| ***C23G 1/36*** | (2006.01) |
| ***C23G 1/08*** | (2006.01) |
| ***C23C 2/08*** | (2006.01) |
| ***C23C 2/26*** | (2006.01) |
| ***C23C 2/36*** | (2006.01) |

(52) U.S. Cl.
CPC ..... *C23G 1/36* (2013.01); *C23C 2/02* (2013.01); *C23C 2/08* (2013.01); *C23C 2/26* (2013.01); *C23C 2/36* (2013.01); *C23G 1/083* (2013.01)

(58) Field of Classification Search
CPC ..... C23G 1/083; C23G 1/36
See application file for complete search history.

(56) References Cited

U.S. PATENT DOCUMENTS

| | | | | |
|---|---|---|---|---|
| 1,279,331 | A | 9/1918 | Gravell | |
| 2,087,230 | A | 7/1937 | Bigeon | |
| 2,558,445 | A | 6/1951 | Laurenson | |
| 2,806,000 | A | 9/1957 | Streicher | |
| 2,975,029 | A | 3/1961 | Horton et al. | |
| 3,438,799 | A | 4/1969 | Eck et al. | |
| 4,255,407 | A | 3/1981 | Puurunen | |
| 4,749,455 | A * | 6/1988 | Lasch | G21F 9/06 205/673 |
| 8,603,420 | B2 * | 12/2013 | Boiko | C01B 7/0706 423/140 |

FOREIGN PATENT DOCUMENTS

| | | | |
|---|---|---|---|
| CN | 102021591 | A | 4/2011 |
| CN | 102925883 | A | 2/2013 |
| WO | 01/49901 | A1 | 7/2001 |
| WO | 2009/075710 | A1 | 6/2009 |

OTHER PUBLICATIONS

International Search Report from a foreign patent office in a counterpart foreign application—WO2015162604—mailed Aug. 3, 2015 (5 pages).
Written Opinion of the International Search Authority from a foreign patent office in a counterpart foreign application—WO2015162604—mailed Aug. 3, 2015 (4 pages).

* cited by examiner

*Primary Examiner* — David Turocy
(74) *Attorney, Agent, or Firm* — Roach Brown McCarthy & Gruber, P.C.; Kevin D. McCarthy

(57) ABSTRACT

This invention provides a cost-effective hot-dip galvanization process for ferrous metals, which is regardful to the environment and to the health of the personnel.

18 Claims, 3 Drawing Sheets

GF-2, 25% x200

HCl, 9.8% x200

METHOD AND FORMULATIONS FOR REMOVING RUST AND SCALE FROM STEEL AND FOR REGENERATING PICKLING LIQUOR IN HOT-DIP GALVANIZATION PROCESS

FIELD OF THE INVENTION

The present invention relates to processing the steel surfaces by zinc coating. Particularly, the invention relates to an improvement in the process of hot-dip galvanization.

BACKGROUND OF THE INVENTION

Hot-dip galvanization process removes metal oxide scales and rust which form on the surface of the metals, particularly ferrous metals like steel, and coats the metal surface with a protective layer of zinc. The metal is typically passed through an acid bath referred to as pickle liquor during such a process. Frequently, the pickle liquor is dangerous and aggressive solution of hydrochloric or sulfuric acid. As the metal is treated, metallic salts are produced in the corrosive acid bath. However, the corrosive action also occurs on the unoxidized or descaled portions of the metal being pickled, which is an undesirable consequence of the pickling process as the metal so removed is wasted. Sometimes an inhibitor such as thiourea is included in the bath, which somewhat inhibits the corrosion of the de-rusted and un-scaled metal while having little effect on the descaling action. In order to prevent acid evaporation, several additives are used as well. The formation of the metallic salts reduces the concentration of the pickle liquor acid and, as will be discussed later, also undesirably enhances the strong corrosive effect on the descaled metal. Hence, the metallic salts must be removed from the pickle liquor, and fresh acid added thereto. Spent pickle liquor which is relatively high in metallic salts and low in acid is thus typically bled off from the pickle liquor bath. The unused acid in the spent liquor is, therefore, lost unless recovered. Disposal of the spent liquor containing unused acid is difficult both due to the huge volume of the spent pickle liquor and due to the low pH. The European and U.S. regulations on dumping of low pH materials are becoming increasingly strict, and the material generated from the pickling process normally requires neutralization before landfilling. Another problem is posed by aggressive metal consumption in the pickling liquor, which leads to the formation of an uneven metal surface; the uneven surface necessitates a greater thickness of the zinc coating and increases the zinc consumption. Thus, the currently existing hot dip galvanization process is economically quite expensive and environmentally dangerous.

A number of processes have been developed for regenerating the acids and recycling the metallic compounds in pickling processes, particularly wherein the pickling acid comprises hydrochloric acid and the compounds comprise iron oxides. However, these processes require careful monitoring and substantial energy inputs, which prohibitively increases the costs of the pickling process with a recovery system. In addition, when using hydrochloric or sulfuric acid, the environmental pollution is always prominent, and there is need to capture and neutralize hazardous fumes, which increases the energy requirements and the costs still more.

U.S. Pat. No. 8,603,420 discloses a technology including the acid regeneration and recycling, but it relates to hydrochloric acid with all its mentioned drawbacks. It is known that pickling by phosphoric acid is a process without the acid evaporation problems and without strong consumption of the clean metal surface. Phosphoric acid is used to remove rust and corrosion products when pitting and rerusting must be minimized. Phosphoric acid is not as corrosive in concentrated form as sulfuric acid or nitric acid, and it does not fume like hydrochloric, nitric or hydrofluoric acids, and it will not attack stainless steel as does hydrochloric or sulfuric acid. However, the high price limits the use of phosphoric acid in this industry, and the lower pickling rate still more restricts the use of phosphoric acid in large operations. Therefore it is essential to regenerate and to recycle the phosphoric acid in order to decrease the cost of its use in the hot-dip galvanization. U.S. Pat. No. 1,279,331, U.S. Pat. No. 2,558,445 and U.S. Pat. No. 3,438,799 describe phosphoric acid as an additive to sulfuric or hydrochloric acid to prevent iron or steel from subsequent rusting. U.S. Pat. No. 2,087,230 describes regeneration of phosphoric acid in pickling technology using hydrochloric or sulfuric acid for removing ferrous salts, but the method is complex and expensive, and not too reliable. U.S. Pat. No. 1,992,045 provides a rust cleaning or preventing solution based on phosphoric acid with additives of sulfonated vegetable oil and ethyl alcohol. U.S. Pat. No. 2,806,000 describes a stainless steel cleaning solution containing phosphoric acid, minor amounts of ferric ion as a corrosion inhibitor, and agents like oxalic acid or sodium bisulfate to improve the cleaning properties, but discarding the spent pickle liquor after its use makes the process uneconomical. U.S. Pat. No. 2,975,029 describes the use of cation exchange resins in regenerating the pickling acids, including hydrochloric, sulfuric, phosphoric, hydrofluoric, and nitric. CN 102925883 and CN 102021591 provide acidic pickle liquor and degreaser compositions based on phosphoric acid, but without solving the problems associated with disposing the spent compositions. U.S. Pat. No. 4,749,455 provides a method of treating an aqueous phosphoric acid solution with oxalic acid. It is an object of the invention to replace the pickling liquor containing hydrochloric or sulfuric acid by a less dangerous pickling liquor, based on phosphoric acid, and further to provide a safe and cost effective way to recycle said phosphoric acid.

It is also an object of the invention to provide a pickling process that does not form dangerous gaseous side products, that reduces excess digestion of the metal being pickled, that allows continuous regeneration of the pickling liquor and finally that allows removal of the ferrous salt from pickle liquor as a marketable product.

It is further an object of the invention to provide a hot dip galvanization process that allows formation of a uniform, thin but effective zinc coating.

It is another object of the invention to provide an environmentally friendly and cost-effective hot dip galvanization process.

Other objects and advantages of present invention will appear as the description proceeds.

SUMMARY OF THE INVENTION

This invention provides a hot-dip galvanization process for ferrous metals comprising the steps of i) removing metal oxide scales and rust from said metal surface, comprising contacting said surface with a liquid composition comprising phosphoric acid, a hydrophilic polymer, a non-ionic surfactant, and an anti-smut and degreasing agent (shortly called anti-smut agent throughout), wherein said liquid composition solubilizes iron oxides forming said scales and rust without solubilizing non-oxidized metal in said surface and concomitantly stabilizing the surface against oxidation, thereby preparing said surface for zinc-coating (said liquid composition is denoted GF2 throughout); and ii) binding the solubilized iron from said GF2 in an insoluble iron oxalate complex by contacting said GF2 with a solid composition comprising oxalic acid, a nucleation agent for crystallization of the iron oxalate (shortly called nucleation agent or nucleation crystallization agent), and an anionic surfactant (the solid composition is denoted GF1 throughout), and removing said insoluble iron oxalate complex from said liquid composition, thereby recovering phosphoric acid in GF2 for further use; wherein the use of GF2 in said step i) avoids the formation of dangerous gaseous side products during said rust solubilization and surface stabilization, and to make a uniform, thin and effective zinc coating during the following galvanization step, and wherein the use of GF1 in said step ii) enables recovery and recycle of phosphoric acid; wherein the combination of steps i) and ii) results in an environmentally safe and cost-effective hot-dip galvanization process. Said GF2 may comprise, beside phosphoric acid, industrial degreasers of various types, including d-limonene and others, but preferably it comprises an anti-smut and degreasing agent comprising phosphonic acid derivatives. In a preferred embodiment, said GF2 comprises 7-40 wt % phosphoric acid, 0.5-3 wt % hydrophilic polymer, 0.1-1 wt % non-ionic surfactant, and 0.05-0.5 wt % anti-smut agent. Said GF1 preferably comprises 96.5-99 wt % oxalic acid dihydrate, 1-3 wt % of iron oxide as the nucleation agent, and 0.05-0.5 wt % of the anionic surfactant. Said hydrophilic polymer preferably comprises polyalkylene glycol (PAG) or polyvinyl alcohol (PVA). Said non-ionic surfactant may comprise an ether of alkylphenols. Said anti-smut agent preferably comprises phosphonic acid, polyphosphonic acid, or esters thereof.

Said anionic surfactant may be sodium lauryl sulfate (SLS). Said nucleation agent is preferably an oxide selected from $Fe_2O_3$, $Fe_3O_4$, and FeOOH. In a preferred embodiment of the galvanization process of the invention, said step i) comprises preparing a pickle liquor which is essentially composition GF1 or an aqueous dilution thereof, and contacting said metal surface with said liquor at ambient temperature or at an increased temperature. Said step ii) comprises recovery of said phosphoric acid and recycling said pickle liquor for repeated use. In one embodiment, the hot-dip galvanization process of the invention is a continuous process or a batch process.

In a preferred embodiment, the hot-dip galvanization process of the invention comprises the steps of i) removing metal oxide scales and rust from said surface by contacting with a pickle liquor consisting essentially of composition GF2 or an aqueous dilution thereof, containing phosphoric acid, a hydrophilic polymer selected from PAG and PVA, a non-ionic surfactant selected from ethers of alkylphenols, and an anti-smut agent from phosphonic acid, polyphosphonic acid, and esters thereof, thereby obtaining a clean metal surface without excessive dissolution of said metal; ii) binding the solubilized iron from the used pickle liquor by contacting with a solid precipitating composition consisting essentially of composition GF1 (said binding in fact sequestering the solubilized iron in the precipitate while releasing phosphoric acid from iron compounds), said GF1 containing oxalic acid, an iron oxide as a nucleation agent for crystallization of the iron oxalate, and an anionic surfactant, and removing said iron oxalate from said liquor, thereby recovering and recycling said phosphoric acid for further use; iii) coating said surface cleaned from rust and scale with a zinc layer, wherein said step i) enables formation of a uniform, thin and effective zinc layer, thereby reducing the zinc consumption; and iv) washing and drying said iron oxalate from step ii), thereby obtaining a useful side product of pure iron oxalate.

The invention aims at a hot-dip galvanization process according to the above description, in which said step i) obviates employing acids which form dangerous gaseous side products during said surface cleaning and stabilization, and wherein said step ii) obviates discarding used pickle liquor containing phosphoric acid and enables recycle of said phosphoric acid. Said process thus comprises i) the step of replacing hydrochloric or sulfuric acids, in the pickling stage of a hot-dip galvanization process employing hydrochloric or sulfuric acid, by a safer replacement agent which does not form a dangerous gas side-product and which does not excessively dissolve the non-rusty metal surface; and ii) the step of removing excessive iron from the pickling solution without the evaporation of said solution by employing a precipitating agent; wherein said replacement agent comprises phosphoric acid and said precipitation agent comprises oxalic acid.

In some preferred embodiments, the hot-dip galvanization process for cleaning and stabilizing the surface of ferrous metals according to the invention comprises the steps of i) preparing composition GF2 containing phosphoric acid, a hydrophilic polymer, a non-ionic surfactant, and an anti-smut agent and optionally diluting the composition with water, and employing said composition as a pickle liquor for contacting said surface to be cleaned and stabilized and to solubilize the iron in said scale and rust; ii) preparing solid composition GF1 containing oxalic acid, a nucleation agent for crystallization of the iron oxalate, and an anionic surfactant, and contacting used composition GF2 from step i) with said composition GF1, thereby crystallizing said solubilized iron as insoluble iron oxalate and recovering said phosphoric acid for further use as the pickle liquid; and iii) washing and drying said iron oxalate from step ii); whereas the combination of steps i) to iii) obviously provides an environmentally friendly and cost-effective hot-dip galvanization process. Said step i) may comprise preparing a concentrate of said GF2 containing up to 88 wt % phosphoric acid, up to 6 wt % of hydrophilic polymer, up to 1.5 wt % of non-ionic surfactant, and up to 0.8 wt % anti-smut agent, wherein the working pickle liquor may be obtained from the concentrate by diluting with water. The working temperature will usually be 40-95° C., and the process time will decrease with increasing temperature. The hot-dip galvanization process of the invention may comprise steps of i) withdrawing at last a portion of the spent pickle liquor from pickling bath and transferring it to a regenerating reactor provided with a stirrer and a feeder for feeding GF1 composition; ii) adding solid GF1 composition into the reactor, thereby precipitating needle-shaped iron-oxalate; and adjusting the concentration of the components in regenerated GF2 to a desired level; iii) withdrawing a slurry comprising the precipitate from the reactor onto a belt or press filter, and separating iron oxalate from the pickle liquor; iv) transferring said pickle liquor from step iii) back to the pickling bath; v) washing said iron oxalate precipitate with water until pH 4.5-7.0 in the washing liquid and drying the precipitate on the belt filter; vi) completing water into the pickling bath as a compensation of evaporation; and optionally vii) adjusting the concentration of the components in GF2 to a desired level.

BRIEF DESCRIPTION OF THE DRAWINGS

The above and other characteristics and advantages of the invention will be more readily apparent through the following examples, and with reference to the appended drawings, wherein.

DETAILED DESCRIPTION OF THE INVENTION

Figure 1:
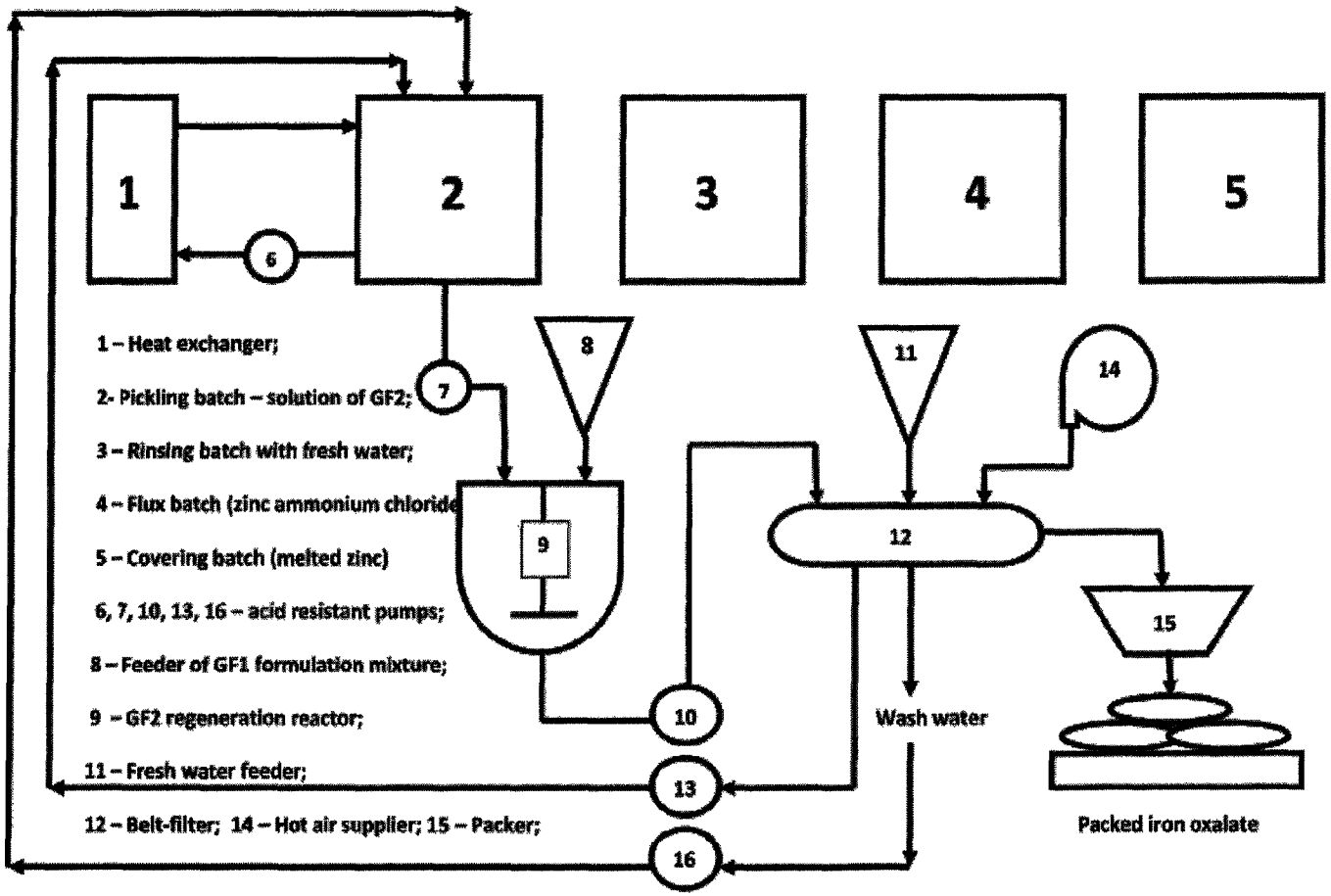
FIG. 1. is a schematic flow diagram of environmentally friendly hot dip galvanization process of the invention, including the regeneration of spent pickling solution comprising GF2.

It has now been found that the process for removing mill scale and rust from a ferrous metal surface, for example steel surface, by employing pickling and hot-dip galvanization may be made both more environmentally friendly and cost effective by incorporating several important changes, comprising at least the steps of (a) replacing hydrochloric or sulfuric acid during the pickling stage by a safer substitute agent and (b) removing excessive iron from the pickling solution without its evaporation by employing a precipitating agent. It has been found that the replacement of hydrochloric and sulfuric acids with phosphoric acid, and the removal of dissolved iron in the form of an easily removable crystalline precipitate of iron oxalate salt from the pickling solution enables running the whole process more easily and in compliance with the ecological requirements, while also achieving material savings. Said replacement is advantageously achieved by employing a composition (the composition being denoted GF2 throughout) comprising phosphoric acid as both a rust and scale remover and as a corrosion stabilizer for the cleaned metal surface, a hydrophilic polymer, a non-ionic surfactant, and a second anti-smut agent beside phosphoric acid, shortly called anti-smut agent herein. The phosphoric acid, in addition to solubilization of rust and scale and stabilization of the cleaned metal surface against corrosion, also reduces solubilization of the freshly-exposed metal in the treated surface. Removal of dissolved iron from composition GF2 is advantageously achieved by employing a composition (denoted as GF1) comprising oxalic acid, a nucleation agent for crystallization of the iron oxalate (denoted shortly as nucleation agent), and an anionic surfactant. Said GF2 may contain, for example, phosphoric acid in an amount of 7-40 wt % such as 7-35 wt % or such as 30 wt %, hydrophilic polymer in an amount of 0.5-3 wt % such as 1-3 wt % or 2 wt %, non-ionic surfactant in an amount of 0.1-1.5 wt % such as 0.1-1 wt % or 0.5 wt %, and anti-smut agent in an amount of 0.01-0.8 wt % such as 0.05-0.5 wt % or 0.2 wt %. Said GF2 is preferably an aqueous composition comprising 7-40 wt % phosphoric acid, 0.5-3 wt % hydrophilic polymer, 0.1-1 wt % non-ionic surfactant, and 0.05-0.5 wt % anti-smut agent. Said GF1 is preferably a solid composition comprising 96.5-99 wt % oxalic acid dihydrate, 1-3 wt % of iron oxide as the nucleation agent, and 0.01-0.5 wt % of the anionic surfactant such as 0.01-0.1 wt % or 0.1 wt %. Said nucleation agent is preferably selected from $Fe_2O_3$, $Fe_3O_4$, and FeOOH. Said anionic surfactant may be sodium lauryl sulfate (SLS). Said hydrophilic polymer preferably comprises polyalkylene glycol or polyvinyl alcohol, such as polyethylene glycol. Said non-ionic surfactant preferably comprises ethers of alkylphenols, such as ethoxylated or alkoxylated phenylene ethers. Said anti-smut agent preferably comprises phosphonic or polyphosphonic acid or an ester thereof, for example hydroxyethylidene-1,1-diphosphonic acid.

As explained, the process of stabilizing the surface of iron and steel against corrosion often comprises removing mill scale—oxide flakes covering the surface of iron or steel as produced in steel mills—followed by hot-dip galvanization, resulting in a relatively strong zinc carbonate layer formed as a result of passivation process. The galvanized steel is used for many applications at lower cost than stainless steel. The scale removal is performed by pickling, during which an aqueous solution of strong acids, pickle liquor, removes the surface impurities. Most usually, the acids comprise hydrochloric acid and sulfuric acid. Spent pickle liquor is a hazardous waste, which must be treated before being disposed of. Alternative and environmentally more friendly processes were developed, based on mechanical treatment including brushing and abrasion, but they require quite a complex machinery. Therefore, a need is still felt for new methods of steel surface processing, which would be cost effective and ecologically acceptable. A typical method of the steel surface treatment includes steps of degreasing, commonly using basic or acidic solutions, rinsing the caustic with pure water, pickling in an acidic solution, rinsing with pure water, covering by flux, which includes applying zinc ammonium chloride to inhibit oxidation of the cleaned surface, dipping in the molten zinc bath, and quenching. The disadvantages of the method include (a) the use of dangerously aggressive acids like hydrochloric or sulfuric during pickling, (b) large losses of iron during the pickling step, (c) the need of absorbing the acids after their evaporation to comply with the environmental requirements, (d) the formation of uneven and/or too thick zinc layer during the hot-dip galvanization, (e) the need to neutralize and/or dispose of the used pickling solution. This invention aims at stabilizing the steel or iron surface without the drawbacks of the known procedures, by means of an environmentally friendly method for removing rust and mill scale from iron and steel in hot-dip galvanization and for forming a thin and uniform zinc layer on the processed metal surface, while possibly also saving raw materials including zinc, iron, and water. This invention provides formulations for the environmentally friendly process of removing rust/mill scale from steel to be employed in the stage of pickling and so improve the method, wherein the improvement comprises at least the steps of (a) replacing hydrochloric or sulfuric acid during the pickling stage by a safer substitute agent (abbreviated here as GF2) and (b) removing excessive iron from the pickling solution without its evaporation by employing a precipitating agent (abbreviated here as GF1). The improvement according to the invention provides a thin and uniform zinc layer on the processed iron surface. Said improvement provides savings in raw materials including zinc, iron, and water, but the savings may include other materials and energy. The improvement of the invention provides an environmentally friendly and cost effective process. Said safer substitute agent comprises phosphoric acid, polyalkylene glycol, at least one non-ionic surfactant, and said precipitating agent comprises oxalic acid. Throughout this text, when relating to only iron or to only steel, always intended is both iron and steel.

The existing methods for steel surface treatment often include the steps of i. degreasing with caustics;
ii. rinsing by fresh water after degreasing;
iii. pickling in the acid (hydrochloric or sulfuric);
iv. rinsing by fresh water after pickling;
v. covering by flux (solution of zinc ammonium chloride);
vi. covering by zinc in the melted zinc; and
vii. disposing of the used pickle solution.

The disadvantages of the existed method include the use of dangerous aggressive acids during pickling, great losses of iron during pickling, uneven or too great thickness of the zinc layer, the need of neutralizing the used pickling solution, and the need of absorbing the acids after their evaporation from the solution. In one embodiment of the method according to the invention, the above step ii may be omitted, if the degreaser is acidic. Importantly, the instant method employs agent GF2 as a substitute for obligate hydrochloric or sulfuric acid in said step iii. Instead of the above step vii, the instant invention comprises a step of regenerating the pickling solution and recycling the used materials, either in a continuous mode or in a batch mode, by using precipitating agent GF1.

The invention provides a method for mill scale/rust removal employing phosphoric acid and oxalic acid, and it includes the steps of pickling in a liquor comprising GF2, rinsing with fresh water, covering by flux (solution of zinc ammonium chloride), covering by zinc in the molten zinc, and regenerating the GF2-based pickling solution and recycling the materials in a continuous or batch mode, while employing GF1.

The advantages of the method according to the invention include (a) canceling the above rinsing step after acidic degreasing;
(b) absence of the dangerous evaporation products, and obviating the need of their absorption;
(c) reduction of the iron losses in time of pickling;
(d) formation of thin and uniform zinc layer on the pickled iron surface;
(e) saving zinc for iron coating, the savings reaching at least 15%, such as at least 20%, typically up to 30 wt %; and
(f) almost complete regeneration and recycling of GF2 pickling liquor, without losses during iron oxalate wash.

The invention provides an environmentally more benign process of hot-dip galvanization, which replaces sulfuric and hydrochloric acids by a liquid formulation comprising GF2, which is used in a process of steel pickling. Solid GF1 is used for regenerating pickling solution from spent or working GF2-based pickle liquor, comprising in one embodiment of the invention continuous circulation of hot pickling solution, and returning GF2 after phosphoric acid regeneration and after separation of solid iron salt. The quality of zinc covering is higher than in traditional hot dip galvanization, and the zinc consumption is lower than in the existing hot dip galvanization methods for ferrous metals. The invention allows to simply and completely regenerate the spent pickle liquor, by employing GF2, independently of phosphoric acid concentration levels, and to remove a part of divalent iron as ferrous oxalate with specific crystal shape which is a useful marketable product.

Figure 2:
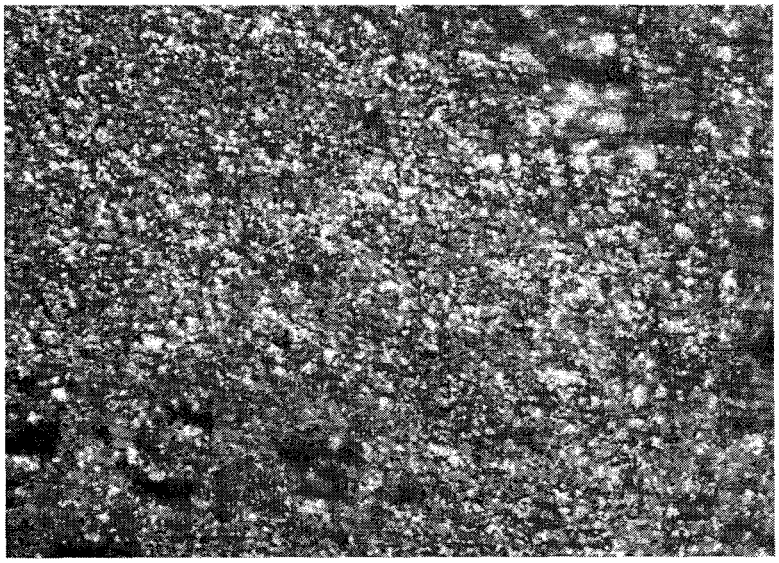
FIG. 2. is a microscope picture of a metal surface treated with GF2 formulation or with a traditional HCl-based liquor, in a process of hot-dip galvanization.
Figure 2:
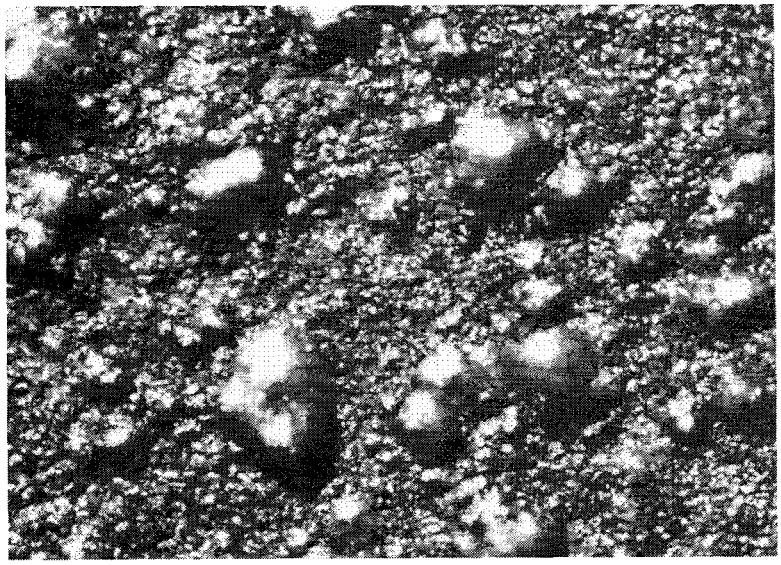

The process according to one embodiment of the invention is schematically presented in FIG. 1. A ferrous metal is pickled in a liquid comprising GF1 formulation, which can be diluted according to the need, usually comprising 7-40 wt % phosphoric acid. The hot-dip galvanization process of the invention includes the steps of a) rust/scale removing in batch 2; b) metal rinsing by fresh water in batch 3; c) covering by flux solution in batch 4; and d) coating with zinc in batch 5. Working GF1 formulation (15-40 wt % phosphoric acid aqueous solution) is used in batch 2 for pickling of ferrous metal at the operating temperature of 40-95° C. until the phosphoric acid concentration decreases to about 7 wt %. The temperature of pickle solution must be more or less constant and it is supported by solution circulation between heat exchanger 1 and pickling batch 2 by pump 6. For the batch process, the preferable working temperature lies in interval 40-60° C. The pickling duration is usually 10-45 min. For the continuous pickling of ferrous metals, the preferable working temperature is 90-95° C. At such temperatures, the pickling duration is 40-60 second. The spent pickle liquor is pumped by pump 7 from pickling batch 2 into reactor 9 for the regeneration. The GF2 regeneration process takes place at ambient temperature, or at a temperature of batch 2 resulting from GF1 formulation added into the reactor 9 by feeder 8. The regeneration process takes 1-6 h and is controlled by divalent iron quantity in the solution. The quantity of GF1 formulation for the regeneration is defined by ferrous cation quantity in the spent pickle liquor, according to molar ratio $Fe^{2+}$:oxalic acid=1:2.25. After the regeneration is complete, the slurry produced inside reactor 9 is pumped by pump 10 to the belt or press filter 12 for the solid phase separation, washing and drying. This slurry composition is a mixture of needle shape ferrous oxalate (solid phase) and a solution of GF2 formulation (liquid phase). Fresh water for the solid phase washing is supplied to the belt filter 12 by feeder 11, and hot air for the ferrous oxalate drying is supplied to the belt of filter 12 by hot air supplier 14. The regenerated solution of GF2 formulation is pumped by pump 13 directly to the pickling batch or to the storage tank. Washed and dried ferrous oxalate goes to the packer 15, where it is packed in plastic bags for storage and transportation. The wash water is pumped by pump 16 into pickling batch 2 as compensation of evaporated one. FIG. 2 illustrates the difference between metal surfaces treated 40 minutes by a traditional composition (based on HCl) and a composition of the invention (GF2-based). The surface structures and grains observed in the microscope are about ten times smaller in their average size in case of metal surface treated according to the invention than in case of the surface treated according to the known method. The results demonstrate some of the advantages characterizing the process of the invention.

The invention will be further described and illustrated by the following examples.

EXAMPLES

Example 1

GF2 formulation for pickle liquor was prepared by mixing the following components: 808.8 g of "green" (agricultural grade) of phosphoric acid (76.8 wt % of $H_3PO_4$), 21 g of nonyl phenol ethoxylate (NP10), 3.4 g of hydroxyethylidene-1,1-diphosphonic acid, 1.7 g of 2-bromo-2-nitropan-1.3-diol, 40 g of PEG-400 (polyethylene glycol 400) as a corrosion inhibitor and viscosity increaser and as a modifier of iron-bearing solid in time of GF2 regeneration, and water to a total volume of 1.750 liter. The GF2 formulation pickle liquor contained 29.72 wt % of $H_3PO_4$, 2 wt % of PEG-400, 0.5 wt % of nonyl phenol ethoxylate (NP10) as non-ionic surfactant, 0.2 wt % of hydroxyethylidene-1,1-diphosphonic acid as anti-carbon smut and additional degreasing agent; and 0.1 wt % of 2-bromo-2-nitropan-1.3-diol as preservative.

The prepared GF2 formulation pickle liquor was put into a 5 l glass batch and heated till 50° C. A strongly rusted piece of ferrous metal was chosen for the pickling. The initial weight of metal piece was 493.5 g (sample 36). The metal piece was put into hot (50° C.) GF2 formulation pickle liquor. The pickling duration was 40 min. After pickling this metal piece was washed, dried and weighted. The weight of pickled metal piece was 486.6 g. The weight loss was 6.9 g or 1.42 wt %. Almost complete rust and mill scale removal was achieved after 30 min of pickling (weight loss was 6.7 g) and during the next 10 min the weight loss was 0.2 g. The surface test showed a complete absence of rust and mill scale. After pickling this metal piece was treated by standard flux solution of zinc ammonium chloride and covered by metallic zinc inside batch of molten zinc. After hot-dip galvanization this piece was weighted again. The weight of the covered piece was 508.99 g. The zinc quantity spent for the covering was 15.49 g or 3.18 wt % of the piece's weight. The zinc cover was tested under microscope and it showed good results. The prepared pickle solution was used again for the pickling of another strongly rusted ferrous metal piece for 40 min. The initial weight of the piece was 524.9 g. The result of pickling was: weight loss of 7.4 g or 1.52 wt % (after 30 min 7.3 g or 1.5 wt %). As a result of pickling the first piece the ferrous cation quantity in the pickle solution increased from 0.36 g/l till 4.46 g/l and after pickling the second piece it increased till 9.08 g/1. The iron in the pickling solution is as cation of acidic ferrous phosphate ($Fe(H_2PO_4)_2$) solution, which formed as a result of chemical reactions during the time of ferrous metal pickling:

a) iron rust dissolving in a presence of free iron metal

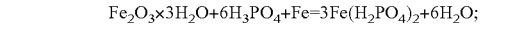

$$Fe_2O_3 \times 3H_2O + 6H_3PO_4 + Fe = 3Fe(H_2PO_4)_2 + 6H_2O;$$

b) mill scale dissolving

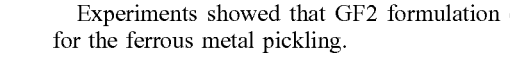

$$FeO + 2H_3PO_4 = Fe(H_2PO_4)_2 + H_2O.$$

Experiments showed that GF2 formulation can be used for the ferrous metal pickling.

Figure 3:
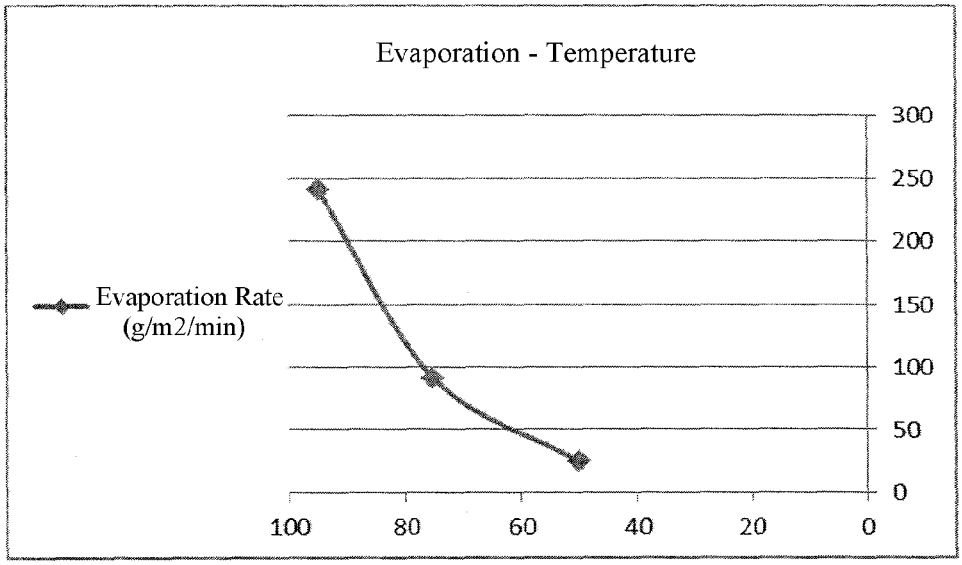
FIG. 3. is a graph showing the dependence of the water evaporation rate of pickling GF2-based solution on the pickling temperature.

For the comparison of the invention's pickling quality with traditional pickling by hydrochloric acid, one sample of strongly rusted ferrous metal was taken and pickled at the same time. The hydrochloric acid concentration was 9.85 wt % or 115.24 g/l of HCl. The ferrous cation quantity in pickle liquor was 65.3 g/l. The temperature of the pickle liquor was 25.6° C. The pickling duration was the same 40 min. The weight of metal piece before pickling was 365.63 g. The weight of metal piece after pickling was 352.11 g. The weight loss was 13.52 g or 3.7 wt %. The weight of the piece after covering by zinc was 367.26 g. The zinc quantity in the cover was 15.14 g or 4.3 wt %. A comparison with GF1 formulation showed that there is large difference in the quantity of dissolved iron and spent zinc. For the GF2 formulation during the time of pickling all dissolved iron quantity was 1.42-1.52 wt % of initial weight. For the hydrochloric acid pickle liquor during the time of pickling all dissolved iron quantity was 3.7 wt % of initial weight. These results show better pickling properties of GF2 formulation in comparison with traditional pickle liquor. The same result we can see if we compare the zinc quantity spent for metal covering. After pickling by GF2 liquor the spent zinc quantity was 3.18 wt % and after pickling by hydrochloric acid the spent zinc quantity was 4.3 wt %. FIG. 2 illustrates the great difference in the metal surface quality after pickling. As a result of hydrochloric acid pickling a strong corrosion effect was observed. As a result of GF1 formulation pickling the corrosion effect was very weak and the metal surface was better for zinc covering. Therefore, 1.18 wt % less zinc was needed for the metal cover after pickling by GF1 formulation pickle liquor. The zinc saving was 27.44 wt %. In time of pickling, the GF1 volume was decreased for water evaporation at pickling temperature 50° C. The evaporated water quantity depending on the pickling temperature is illustrated by FIG. 3.

The experiments were repeated with white phosphoric (Food Grade) acid and other additives with similar results as described. It was found that good pickling results can be achieved at the following components concentrations: Phosphoric acid ("Green" or "White") concentration can be, for example, in the interval from 7 till 35 wt %; PEG-400 concentration can be in the interval 1-3 wt %, preferable 2 wt %. Such concentration is enough for the complete modification of iron oxalate to needle shape (for the best solid separation in time of filtration) and prevents acid activity to dissolve free metal. The concentration more 5 wt % can stop completely the pickling process at the temperature interval of 45-55° C. because of the GF2 high viscosity. As additives, organic hydrophilic polymers can be used, such as poly (alkene glycol), poly (alkene oxide), poly (vinyl alcohol), poly (vinyl acetate) or their mixtures—and water at ambient temperature. PEG-400 is one of preferred additives, supposed to act, among others, as iron oxalate modifier and inhibitor of GF2 pickling activity. Nonyl phenol ethoxylate (NP10) can be used in the interval of 0.1-5.0 wt % preferable 0.3-0.5 wt % As non-ionic surfactants, ethers of alkylphenols based on ethoxylated or alkoxylated ethers of general formula can be used: CH3(CH2)nCH2-C6H4-O—(CH(R)—CH2-O)n'-H(orR'), where n can be 1-20, n' can be 1-1000, R can be $CH_3$ or other alkyl group up to C-8 and R' can be $CH_3$ or other alkyl/aryl-alkyl group with chain length of 2-20 carbons. The ester hydroxyethylidene-1,1-diphosphonic acid can be in the of interval 0.1-2 wt %, preferable 0.2 wt %. As an anti-carbon smut agent can be used the phosphonic or polyphosphonic acid too at the same concentration. 2-bromo-2-nitropan-1.3-diol may be added, for example at 0.05-0.5 wt % such as 0.2 wt %. As a preservative, also 2,2-dibromonitrilopropionamide (DBNPA, C-103) can be used at the same concentration. The pickling temperature can be in the interval of 40-95° C.: 45-60° C. for batch pickling process and 90-95° C. for continuous pickling process.

Example 2

The comparison of hot dip galvanization was made with GF2 and HCl pickle solutions on the industrial scale pilot plant. The industrial scale pickling of ferrous metal constructions was made inside pickling batches with volumes 40 $m^3$ each, filled with GF2 (28 wt % phosphoric acid) and HCl (9.8 wt %). The pickling temperature in the batch of GF2 was 40-45° C., and in the batch of HCl 25° C. The metallic products were weighed before pickling, after pickling and after covering by zinc. Measurement results obtained were recalculated for comparison, which are shown in the Table 1 below.

The industrial pickling test showed similar results, as described in Example 1. The pickling rate by GF2 is less at temperature 40-45° C. than the pickling rate by HCl at temperature 25° C. An increase of GF2 pickling temperature showed drastic reduction of pickling rate. Made several experiments showed the complete iron derusting and descaling during 40-60 sec at pickling temperatures 90-95° C. The pickling with GF2 showed that quantity of spent Zn was less in all galvanized products on comparison with HCl pickling.

TABLE 1

The Results of hot dip galvanization obtained in the industrial scale Pilot Plant.

| Name of product | Pickling solution | Initial weight, kg | Pickling Duration, min | Weight after pickling, kg | Weight decrease, wt % | Rate of pickling, kg/min | Weight with Zn cover, kg | Weight of spent Zn, kg | Zn quantity in covered product, wt % |
|---|---|---|---|---|---|---|---|---|---|
| Welded con-struction | GF2 | 4,838.0 | 140 | 4,836.0 | 0.0413 | 0.01429 | 4,896.0 | 60.0 | 1.2 |
| | HCl | 4,608.0 | 123 | 4,593.0 | 0.1956 | 0.07317 | 4,678.0 | 85.0 | 1.8 |
| Road bump | GF2 | 1,190.0 | 147 | 1,188.0 | 0.1681 | 0.01361 | 1,211.0 | 23.0 | 1.9 |
| | HCl | 1,194.0 | 96 | 1,190.0 | 0.335 | 0.04167 | 1,236.0 | 46.0 | 3.7 |
| Lattice of metal | GF2 | 639.0 | 32 | 641.0 | −0.313 | −0.0625 | 679.0 | 38.0 | 5.6 |
| | HCl | 626.0 | 60 | 626.0 | 0 | 0 | 670.0 | 44.0 | 6.6 |
| Chutes | GF2 | 1,236.0 | 25 | 1,233.0 | 0.2427 | 0.12 | 1,302.0 | 69.0 | 5.3 |
| | HCl | 1,298.0 | 25 | 1,255.0 | 3.3128 | 1.72 | 1,331.0 | 76.0 | 5.7 |

Example 3

Regeneration of GF2 formulation spent pickle liquor. As spent pickle liquor 1.67 liter of GF2 formulation solution was used with density 1.296 g/cm3, and which contained 152.88 g/l or 11.79 wt % of $H_3PO_4$ and 67.39 g/l of $Fe^{2+}$ as solution of $Fe(H_2PO_4)_2$ salt. The GF2 formulation was prepared by mixing the following solid components: dry solid oxalic acid dihydrate ($H_2C_2O_4 \times 2H_2O$, 99.6 wt %) according to the divalent iron quantity that will be removed from the spent pickle liquor. It was defined as 253.21 g for 112.54 g of $Fe^{2+}$ (67.39 g/l×1.67 l=112.54 g). For the GF1 formulation preparation 253.21 g of dry oxalic acid were mixed with 3.17 g of nano-sized iron oxide ($Fe_2O_3$) powder and 0.03 g of dry SLS (sodium lauryl sulfate—$NaC_{12}H_{25}SO_4$). In the GF1 formulation oxalic acid used as the iron precipitating agent, nano-sized iron oxide used for the needle shape ferrous oxalate nuclear crystals preparation and SLS used as the surfactant for the precipitated iron contained solid phase. The solid phase mixing duration was 30 min. In time of solid phase mixing iron oxide powder was reacted with oxalic acid. With an excess of oxalic acid is a strong reducing agent:

$$Fe_2O_3+3H_2C_2O_4 \times 2H_2O=2FeC_2O_4 \times 2H_2O+3H_2O+2CO_2.$$

As a result the needle shape ferrous oxalate crystals were formed, which are the nuclear centers for the needle shape iron oxalate growing in time of GF2 regeneration. Besides $Fe_2O_3$ (preferable) other iron oxide nano-sized powder can be used such as $Fe_3O_4$ or FeOOH. The powder quantity must be enough for the formation 3-5 wt % of nucleation crystals related to the quantity of precipitated in time of GF2 regeneration ferrous iron oxalate. The ready solid GF1 formulation was added with stirring into glass bath containing 1.67 liter of spent pickle liquor. The GF2 formulation pickle liquor regeneration duration was 4 hr at ambient temperature 23° C. The working temperature can be higher than ambient (like in a pickling batch). The temperature increase decreases the duration of GF2 regeneration. During the time of regeneration the following chemical reaction takes place:

$$Fe(H_2PO_4)_2+H_2C_2O_4 \times 2H_2O=FeC_2O_4 \times 2H_2O+2H_3PO_4;$$

After complete reaction between oxalic acid and acidic ferrous phosphate, a yellow precipitate of iron oxalate dehydrate was formed. Addition of ferrous oxalate nucleation crystals makes the precipitate of ferrous oxalate better filterable. As a result a yellow slurry was formed, which consisted of regenerated phosphoric acid (liquid phase) and needle shape ferrous iron oxalate dihydrate (solid phase). These phases were separated by filtration. As a result of regeneration two components were produced: 350.3 g of dried iron oxalate dihydrate and 1.67 l of regenerated GF2 formulation solution, which contained 352.8 g/l of $H_3PO_4$ and 1.0 g/l of $Fe^{2+}$. The regenerated solution density was 1.20 g/cm$^3$. During the time of regeneration the phosphoric acid quantity was increased from 152.88 g/l till 352.8 g/l and the iron quantity decreased from 67.39 g/l till 1.0 g/l. The regenerated solution of GF2 formulation was used for the ferrous iron pickling in Example 4. From the spent pickle liquor the divalent iron was removed as the needle shape iron oxalate dehydrate, which is a useful and marketable product, that can be used in industry, for example in battery or iron oxide powder production. The wash water was collected and then added into GF2 solution instead of evaporated water in Example 1. The wash water had pH 0.9 and concentration of GF2 wt %. The part of produced ferrous iron oxalate can be transformed into iron oxide nano-sized powder by calcination in order to use for GF1 formulation preparation.

Example 4

This example demonstrates the pickling of ferrous metal by regenerated GF2 formulation pickle liquor. 1.5 liter of regenerated GF2 pickle liquor from Example 2 was used for the cleaning of ferrous metal and removing rust and mill scale. The weight of a strongly rusted piece of ferrous metal (sample 38) was 506.1 g. The pickling temperature was 50° C. The pickling duration was 40 min as in Example 1. After pickling finish the metal sample was washed and dried. The weight of the pickled sample was 498.66 g. The weight loss during the in time of pickling was 7.44 g or 1.47 wt %. The consumed iron quantity appears similar to the results from Example 1. The test of the pickled metal surface showed good results. This example showed the same results and the absence of visible difference in the pickling by fresh and regenerated GF2 formulation pickle liquors. The dried pickled ferrous metal piece was treated by standard flux solution (zinc ammonium chloride) and covered by zinc by passing into a batch of molten zinc. The weight of covered metal piece was 513.62 g. The spent zinc quantity was 14.96 g or 3.0 wt %. Such a result is even better in comparison than the result described in Example 1.

It is to be understood that while we have illustrated and described certain embodiments of our invention, it is not to be limited to the specific forms or arrangements of equipment, flows, and materials herein described and shown.

The invention claimed is:

1. A hot-dip galvanization process for stabilizing the surface of ferrous metals comprising steps of i) removing metal oxide scales and rust from said surface in a pickling stage, comprising contacting said surface with a liquid pickling composition, denoted GF2, comprising phosphoric acid, a hydrophilic polymer, a non-ionic surfactant, and an anti-smut agent, wherein said GF2 solubilizes iron oxides forming said scales and rust without solubilizing non-oxidized metal in said surface, thereby preparing said surface for zinc-coating; and ii) binding iron from said GF2 solubilized iron oxide in an insoluble iron oxalate complex by contacting said GF2 with a solid composition, denoted GF1, comprising oxalic acid, a nucleation crystallization agent, and an anionic surfactant, and removing said insoluble iron oxalate complex from said liquid composition, thereby releasing phosphoric acid in GF2 for further use;

iii) protecting said surface by coating with a layer of zinc;

the use of GF2 in said step i) preventing the formation of dangerous gaseous side products and resulting in a uniform and thin zinc layer, and the use of GF1 in said step ii) recovering phosphoric acid;

wherein the combination of steps i) and ii) results in an environmentally safe and cost-effective hot-dip galvanization process.

2. The process of claim 1, wherein said GF2 comprises 7-40 wt % phosphoric acid, 0.5-3 wt % hydrophilic polymer, 0.1-1 wt % non-ionic surfactant, and 0.05-0.5 wt % anti-smut agent.

3. The process of claim 1, wherein said GF1 comprises 96.5-99 wt % oxalic acid dihydrate, 1-3 wt % of iron oxide as the nucleation agent, and 0.05-0.5 wt % of the anionic surfactant.

4. The process of claim 1, wherein said hydrophilic polymer comprises polyalkylene glycol, denoted PAG, or polyvinyl alcohol, denoted PVA.

5. The process of claim 1, wherein said non-ionic surfactant comprises an ether of alkylphenols.

6. The process of claim 1, wherein said anti-smut agent comprises phosphonic acid, polyphosphonic acid, or an ester thereof.

7. The process of claim 1, wherein said anionic surfactant is sodium lauryl sulfate, denoted SLS.

8. The process of claim 1, wherein said nucleation crystallization agent is selected from $Fe_2O_3$, $Fe_3O_4$, and FeOOH.

9. The hot-dip galvanization process of claim 1, wherein said step i) comprises preparing a pickle liquor which is essentially composition GF2 or an aqueous dilution thereof, and contacting said surface with said pickle liquor at ambient temperature or at an increased temperature.

10. The hot-dip galvanization process of claim 1, wherein said step ii) comprises recycling said pickling composition for repeated use.

11. The hot-dip galvanization process of claim 1, which is a continuous process.

12. The hot-dip galvanization process of claim 1, wherein said step i) comprises contacting said surface with a pickle liquor consisting essentially of composition GF2 or an aqueous dilution thereof, wherein said hydrophilic polymer is selected from PAG and PVA, said non-ionic surfactant is selected from ethers of alkylphenols, and said anti-smut agent is selected from phosphonic acid, polyphosphonic acid, and esters thereof; and wherein said step iii) results in creating a thin and uniform zinc layer, thereby reducing the zinc consumption; said hop-dip galvanization process further comprising the steps of washing and drying said iron oxalate from step ii), thereby obtaining a useful side product of pure iron oxalate.

13. The hot-dip galvanization process of claim 1, stabilizing the surface of ferrous metals without forming dangerous gaseous side products and without discarding used pickle liquor containing phosphoric acid.

14. The hot-dip galvanization process of claim 13, comprising replacing hydrochloric acid or sulfuric acid in the pickling stage by a safer replacement agent which does not form a dangerous gas side-product and which does not excessively dissolve the non-rusty metal surface; and removing excessive iron from the pickling composition without the evaporation of said composition by employing a precipitating agent, wherein said replacement agent comprises phosphoric acid and said precipitation agent comprises oxalic acid.

15. The hot-dip galvanization process for stabilizing the surface of ferrous metals according to claim 1, further comprising the steps of iv) preparing said composition GF2 containing phosphoric acid, a hydrophilic polymer, a non-ionic surfactant v) preparing said solid composition GF1 containing oxalic acid, a nuclear crystallizing agent, and an anionic surfactant, and contacting used composition GF2 from step i) with said composition GF1, thereby binding iron in an insoluble iron oxalate complex and recovering said phosphoric acid for further use in said pickling composition; and vi) washing and drying said iron oxalate complex from step v.

16. The hot-dip galvanization process of claim 15, wherein said step iv) comprises preparing a concentrate of GF2 composition containing up to 88 wt % phosphoric acid, up to 6 wt % of hydrophilic polymer, up to 1.5 wt % of non-ionic surfactant, and up to 0.8 wt % of anti-smut agent.

17. The hot-dip galvanization process of claim 15, comprising an increased temperature of 40-95° C.

18. The hot-dip galvanization process of claim 15, further comprising steps of:

vii) withdrawing at least a portion of the spent pickling composition and transferring it to a regenerating reactor provided with a stirrer and a feeder for feeding GF1 composition;

viii) adding solid GF1 composition into the regenerating reactor, thereby precipitating needle-shaped iron-oxalate; and ix) withdrawing a slurry comprising the precipitate from the regenerating reactor onto a belt or press filter, and separating iron oxalate from the pickling composition;

x) transferring said pickling composition from step ix) back to the pickling stage;

xi) washing said iron oxalate precipitate with water until pH 4.5-7.0 in the washing liquid and drying the precipitate on the belt filter;

xii) completing water into the pickling composition as a compensation of evaporation; and optionally xiii) adjusting the concentration of the components in GF2 to a desired level.

* * * * *